US009102384B2

(12) United States Patent
Pierce et al.

(10) Patent No.: US 9,102,384 B2
(45) Date of Patent: Aug. 11, 2015

(54) COMPOSITE TENDER WITH RETRACTABLE BIMINI HARD-TOP

(71) Applicants: Kenneth Pierce, Brandon, FL (US); Mark Levey, Brandon, FL (US)

(72) Inventors: Kenneth Pierce, Brandon, FL (US); Mark Levey, Brandon, FL (US)

( * ) Notice: Subject to any disclaimer, the term of this patent is extended or adjusted under 35 U.S.C. 154(b) by 236 days.

(21) Appl. No.: 13/659,971

(22) Filed: Oct. 25, 2012

(65) Prior Publication Data

US 2013/0104793 A1 May 2, 2013

Related U.S. Application Data

(60) Provisional application No. 61/551,795, filed on Oct. 26, 2011.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC B63B 17/02; B63B 17/023; B63B 2017/026; B63H 21/14
USPC ..... 114/343, 361, 362, 364
See application file for complete search history.

(56) References Cited

U.S. PATENT DOCUMENTS

| | | | | |
|---|---|---|---|---|
| 6,666,163 | B2 * | 12/2003 | Pastor et al. | 114/361 |
| 7,341,016 | B2 * | 3/2008 | Terleski et al. | 114/343 |
| D606,481 | S * | 12/2009 | Stepp | D12/317 |
| 8,205,571 | B1 * | 6/2012 | Rondeau et al. | 114/361 |
| D701,820 | S * | 4/2014 | Pierce et al. | D12/317 |

FOREIGN PATENT DOCUMENTS

| | | | | |
|---|---|---|---|---|
| CA | 2315497 | A1 * | 2/2002 | |
| DE | 19951619 | A1 * | 4/2001 | B63B 35/73 |
| WO | WO 9304912 | A1 * | 3/1993 | |
| WO | WO 2008064695 | A1 * | 6/2008 | B60J 7/14 |

* cited by examiner

*Primary Examiner* — Ajay Vasudeva
(74) *Attorney, Agent, or Firm* — Allen Dyer Doppelt Milbrath & Gilchrist

(57) ABSTRACT

A lightweight tender comprising a hull constructed from substantially a single piece of composite material and a retractable pillar attached to the hull, wherein the retractable pillar defines a longitudinally extending channel. A retractable carbon fiber bimini cover is pivotingly attached to the retractable pillar, and defines a top deck when the pillar is retracted, and defines a bimini top extended. A first end of a brace is hingedly attached to the bimini cover and a second end of the brace travels within the longitudinally extending channel of the retractable pillar such that the angle between the bimini cover and the retractable pillar increases as the brace travels distally within the longitudinally extending channel.

11 Claims, 7 Drawing Sheets

COMPOSITE TENDER WITH RETRACTABLE BIMINI HARD-TOP

CROSS-REFERENCE TO RELATED APPLICATION

This application seeks priority to U.S. Provisional Patent Application Ser. No. 61/551,795 filed on Oct. 26, 2011 entitled "Composite Tender with Retractable Bimini Hard-Top and Associated Methods," the contents of which are incorporated by reference herein.

FIELD OF INVENTION

The present invention generally relates to the field of boating. More particularly, the present invention is in the field of composite tender and dinghy design and manufacturing.

BACKGROUND

Tenders or dinghies are a class of boat typically used to service larger sea vessels. Large sea vessels, such as yachts, often can not dock due to physical restrictions or time constraints. It is therefore advantageous for a yacht to carry an on-board tender for trips from the yacht to the shore.

Tenders are relatively small craft, so the number of passengers that can safely occupy a typical tender is limited. Tenders are ideally small and lightweight so to not be unduly burdensome to the vessel on which the tender resides. Due to size and weight limitations, a yacht's tender is typically either an inflatable boat or a rigid-hulled inflatable boat (RIB).

Inflatable boats are made of soft materials, such as rubber, and are susceptible to punctures which render the boat not seaworthy. Additionally, ultraviolet rays from the sun can cause degradation that compromises the boats integrity. RIBs also have inflatable tubes at the gunwale that are equally susceptible to punctures and degradation. The shape of inflatable boats and RIBs also typically renders them relatively slow vessels as compared to rigid hulled speedboats of the same size and power class.

Additionally, inflatable boats often lack protection from the sun or rain due to their small size and the limited ability to install a bimini top as a result of soft-material construction. This limitation in size combined with the fact that these craft typically have outboard motors also precludes the installation of a large stern diving deck projecting from the transom.

Lastly, the configuration of inflatable boats and RIBs limits the number of passengers that can safely and comfortably occupy the vessel. Much improved vessels are needed in the field.

SUMMARY

Accordingly, an object of the present invention is to provide a lightweight tender that is not susceptible to punctures yet can comfortably seat a number of passengers while not being too large for accommodation by a yacht.

A further object of the present invention is to provide a lightweight tender having a bimini hard top that is retractable to accommodate the constraints of yacht storage while still allowing a means of protection from the elements.

A further object of the present invention is to provide a lightweight tender having comfortable and practical seating accommodations.

A further object of the present invention is to provide a lightweight tender having a folding dive platform to allow recreational activities while accommodating the need to maintain a small storage footprint.

Accordingly, the present invention is directed to a rigid hull yacht tender of carbon fiber construction comprising a retractable bimini hard-top. The tender is of a sleek design to promote performance, can protect the operator from the elements due to a retractable bimini hard-top, is lightweight, has a small profile due to the retractable bimini hard top so that the tender is easily stored on a yacht, has a foldable aft dive deck, and has comfortable and plentiful seating.

In particular, the invention contemplates a lightweight tender with a hull constructed from substantially a single piece of composite material, such as carbon fiber. The hull also has a gunwale and a retractable pillar attached proximate an interior surface of the hull. The retractable pillar has a channel that extends longitudinally along the pillar.

A bimini cover made from a rigid material is pivotingly attached to the retractable pillar. The bimini cover defines a top deck when the retractable pillar is in the retracted orientation, and it defines a bimini top when the retractable pillar is in the extended orientation.

A brace having a first end and a second end is hingedly attached to the bimini cover by its first end, and the second end travels within the longitudinally extending channel of the retractable pillar such that the angle between the bimini cover and the retractable pillar increases as the brace travels distally within the longitudinally extending channel.

In another embodiment, the bimini cover seals against the gunwale when in a closed position, defining a compartment that is substantially sealed.

In yet another embodiment, the retractable pillar comprises a linear actuator that is connected to the second end of the brace for the purpose of moving the brace along the longitudinally extending channel. In a related embodiment, the linear actuator is internal to the retractable pillar. In a preferred embodiment, the bimini cover is made from composite material, such as carbon fiber.

The lightweight tender may further comprise a folding dive platform attached to a transom formed with the hull, wherein the folding dive platform folds upwards into a closed position that is substantially parallel to the transom and also folds outwards into an open position that is substantially perpendicular to the transom.

The lightweight tender also, in a related embodiment, comprises a sponson attached to the hull that substantially circumscribes the tender. The sponson comprises closed cell foam surrounded by a polyurethane sheath.

The tender also comprises an inboard motor.

In an embodiment of the retractable bimini cover, a carbon fiber top panel is of a size and dimension to substantially cover a tender cockpit when in an extended position and to substantially cover a storage space when in a retracted position. A first retractable pillar is hingedly attached to the carbon fiber top panel and to the tender, while a second retractable pillar is also hingedly attached to the carbon fiber top panel and to the tender. A first brace is attached between the first retractable pillar and to the carbon fiber top panel, and a second brace is attached between the second retractable pillar and to the carbon fiber top panel.

A linear actuator with the first retractable pillar is attached to the first brace, wherein the linear actuator changes the position of the first brace on the first pillar to change the angle of the carbon fiber top with respect to the first pillar.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

The present invention will now be described more fully with reference to the accompanying drawings and photos in which alternate embodiments of the invention are shown and described. It is to be understood that the invention may be embodied in many different forms and should not be construed as limited to the illustrated embodiments set forth herein. Rather, these embodiments are provided so that this disclosure may be thorough and complete, and will convey the scope of the invention to those skilled in the art.

Figure 1:
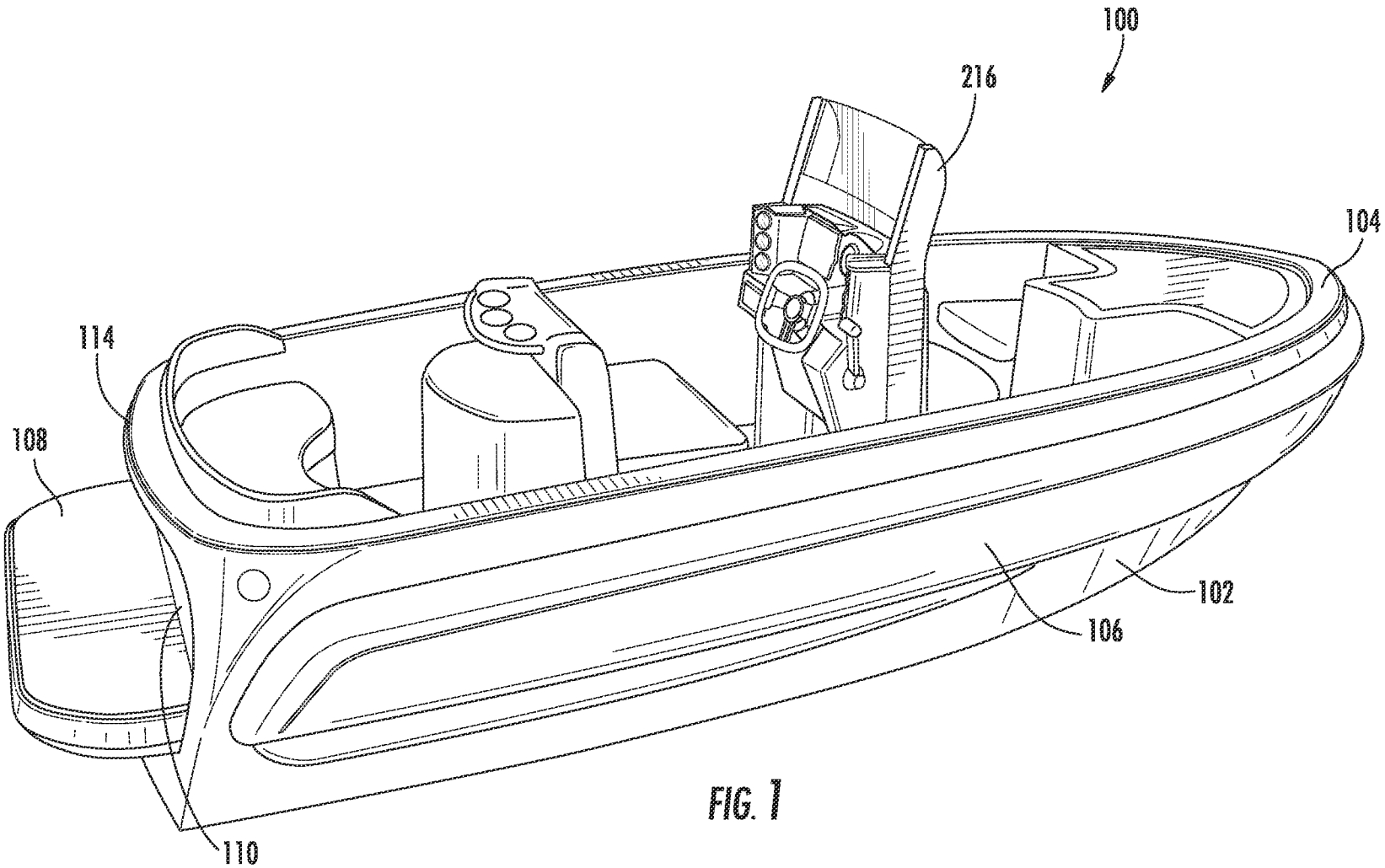
FIG. 1 is a perspective view of one embodiment of the hull of the tender.

With reference initially to FIG. 1, one embodiment of the present invention includes a tender 100 of composite monohull 102 construction. The preferred composite is carbon-fiber-reinforced polymer (also known as carbon-fiber-reinforced plastic, but hereinafter simply "carbon fiber"). However, other composite materials may also be employed instead, or in addition to carbon fiber, including glass fiber and Kevlar®.

The carbon fiber fabric is at least one of a unidirectional fabric, bidirectional fabric, or a woven fabric. At least one layer of carbon fabric is used in the construction of the monohull 102. In embodiments wherein multiple layers of fabric are utilized, the orientation of the fabric layers with respect to each other (e.g. ±45°), is adjusted to maximize integrity of the final structure. This allows the use of non-woven fabric layers, the individual fibers of which remain in a straight orientation (which would otherwise be naturally crimped in a woven fabric), and therefore possess an intrinsically high tensile strength and stiffness allowing greater tensile and compression forces to be absorbed by the final structure. In one embodiment of the construction process, layers of fabric are stitched together before being placed in a hull mold.

A polymer is infused into the composite fiber, being at least one of epoxy, polyester, vinyl-ester, and nylon. Epoxy is the preferred polymer. The polymer is infused into the carbon fiber using at least one of a wet lay-up technique, hand lay-up, hand-lay up with vacuum compression, infusion vacuum compression, and compression molding, all of which are well known in the art. Upon infusion, the composite parts are at least one of air- and heat-cured.

The molds for the monohull 102, deck 104, and any other composite pieces are made from at least one of fiberglass, carbon fiber, aluminum, and any other mold material known in the art. The molds are polished, waxed, and a release agent is applied to the mold before the fabric and resin are applied utilizing methodologies well known in the art.

Figure 2:
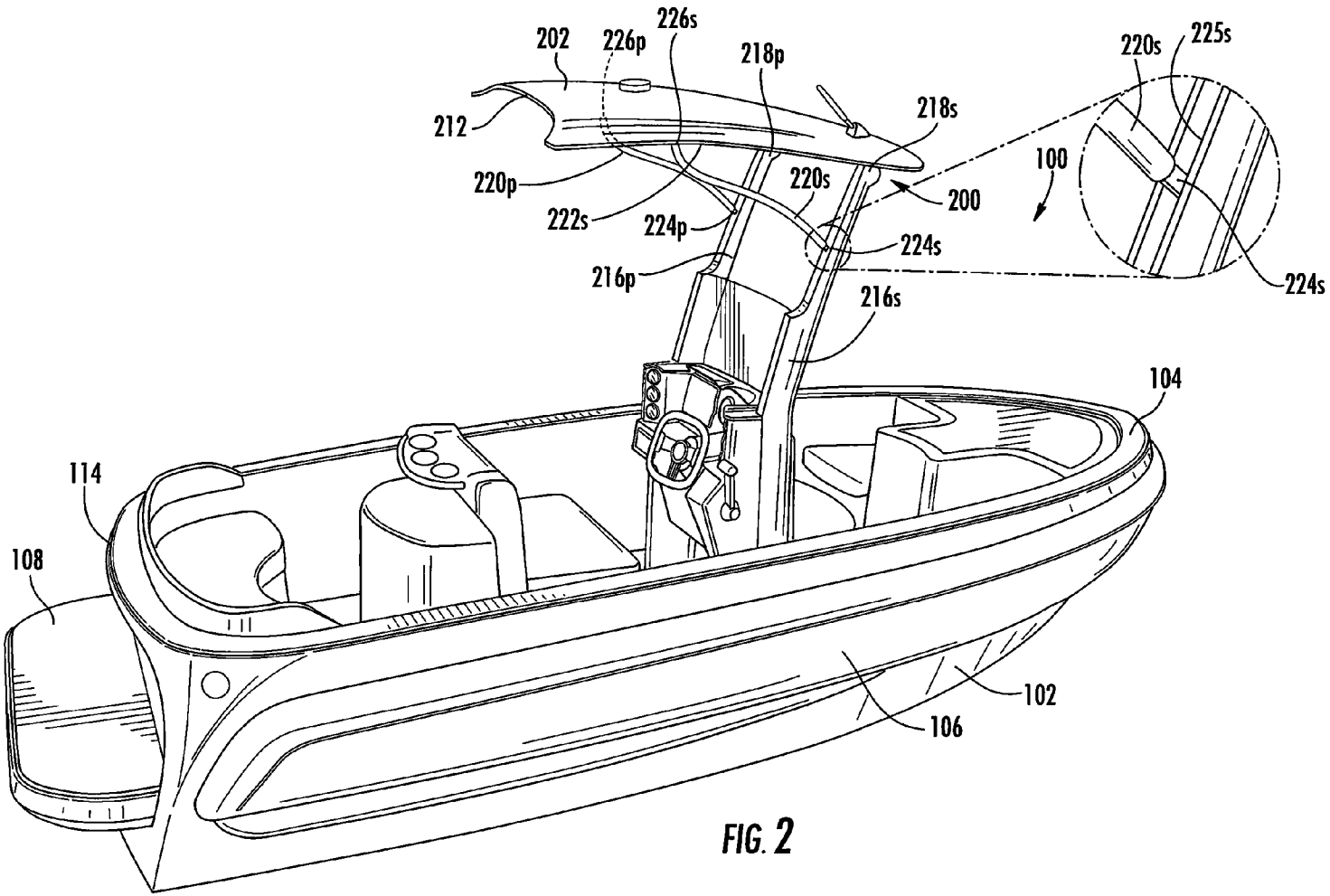
FIG. 2 is a perspective view of one embodiment of the tender hull of FIG. 1 having a bimini hard top.
Figure 3:
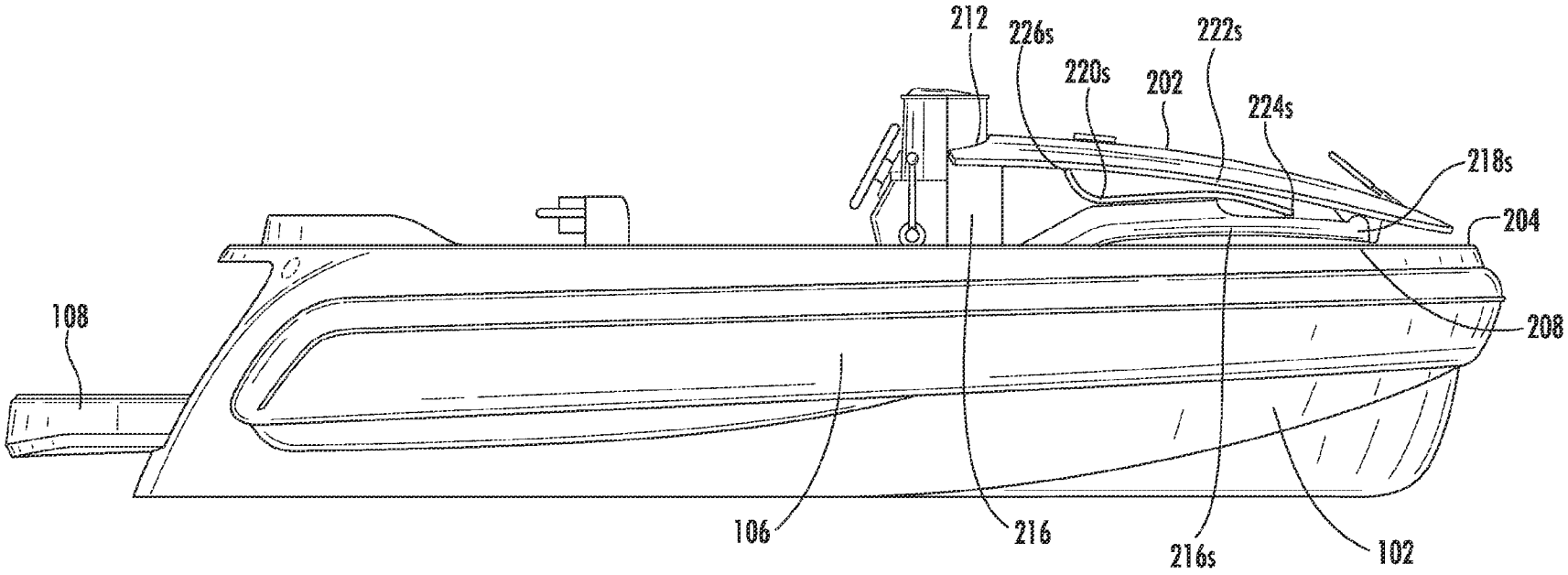
FIG. 3 is a side view of one embodiment of the tender of FIG. 2 with the bimini hard top in a retracted state.
Figure 4:
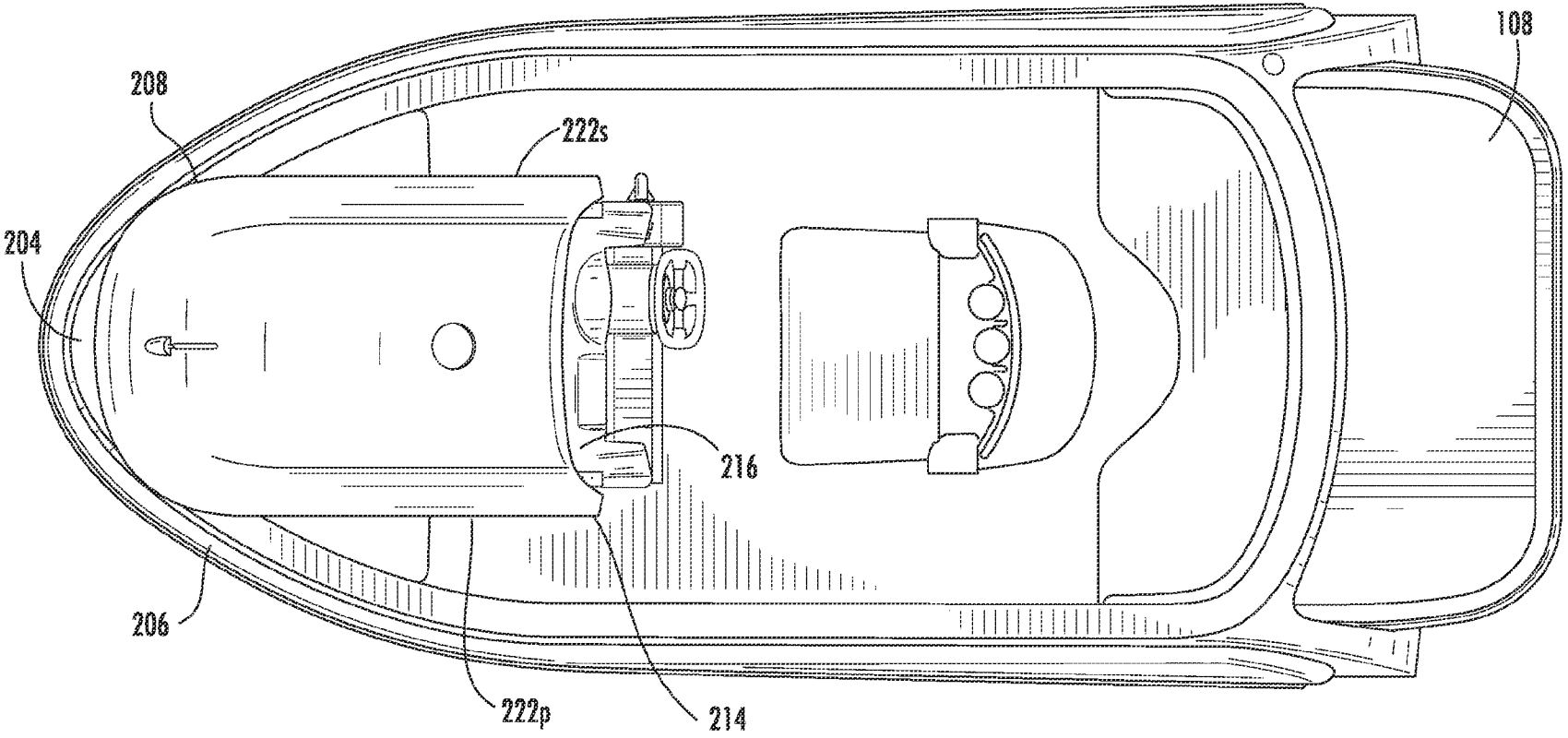
FIG. 4 is a top view of one embodiment of the tender of FIG. 2 with the bimini hard top in a retracted state.
Figure 5:
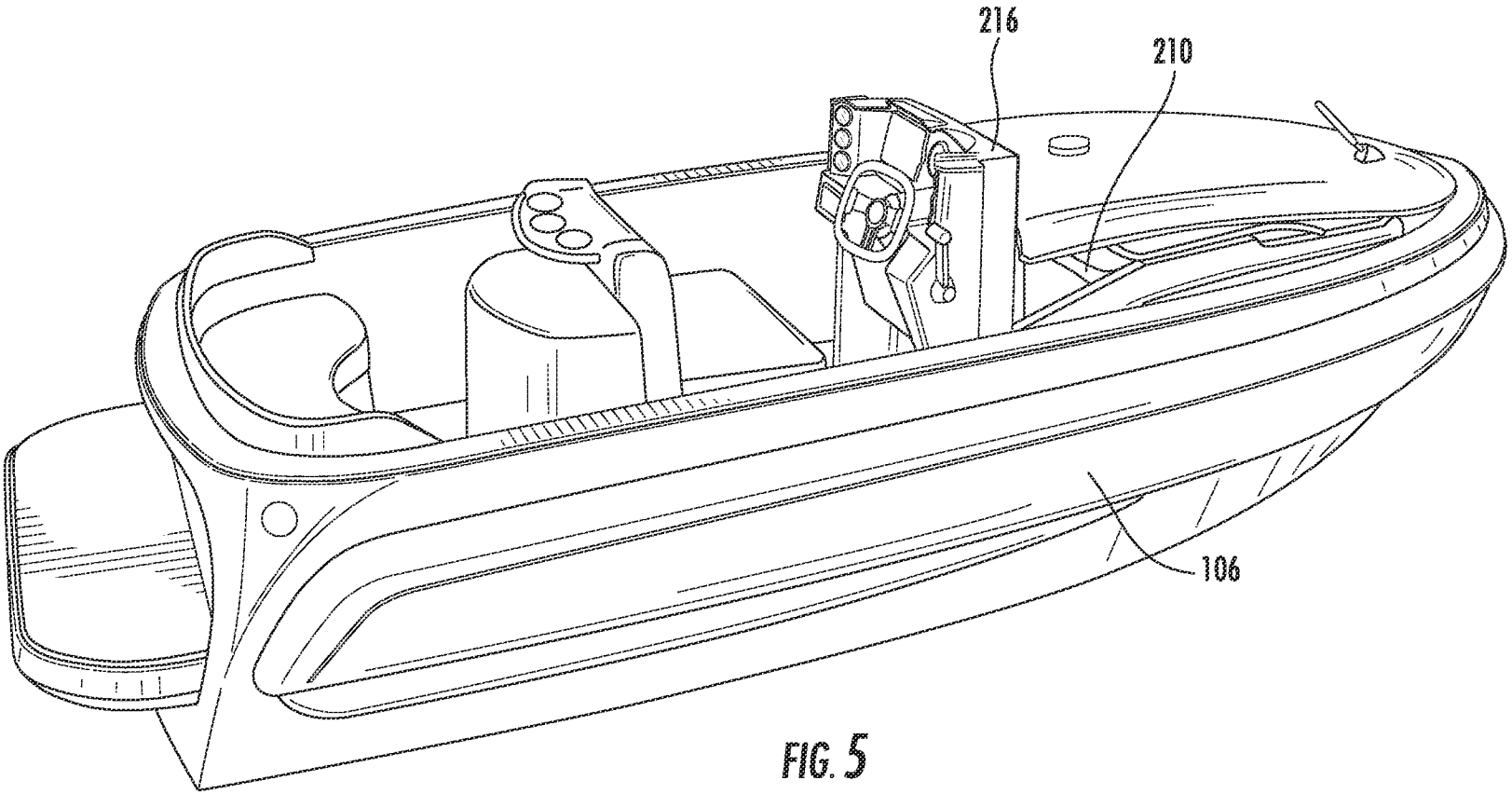
FIG. 5 is a perspective view of one embodiment of the tender of FIG. 2 with the bimini hard top in a retracted state.
Figure 6:
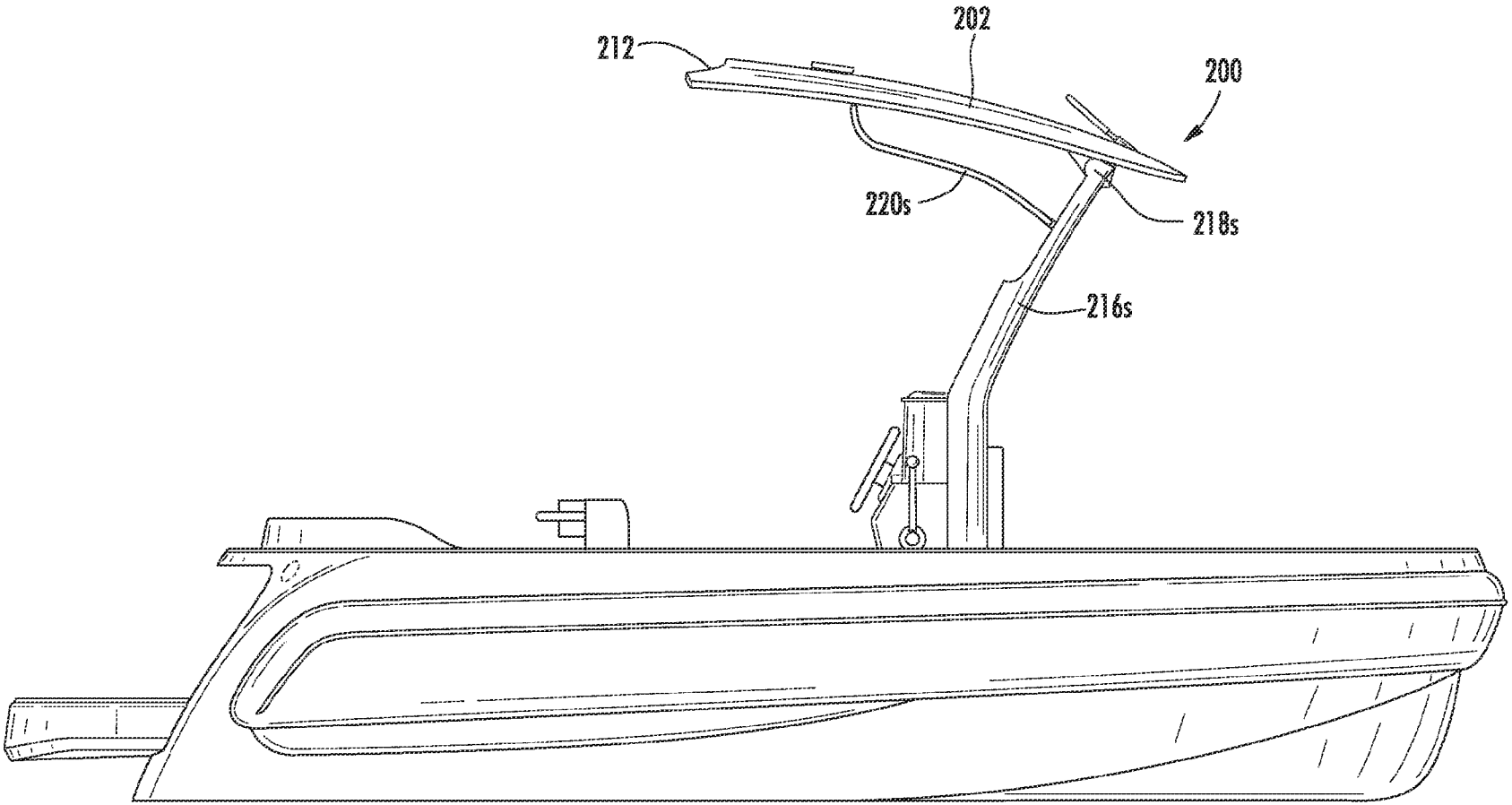
FIG. 6 is a side view of one embodiment of the tender of FIG. 2.

FIG. 2 illustrates the tender 100 comprising a hard bimini top mechanism 200 that is retractable. The retraction mechanism is either manual or motorized. In the upright position, a top panel 202 forms a cover from the elements. In the retracted position (FIG. 3), the top panel 202 forms a cover that extends forward towards the bow bulwark 204 of the tender, and also extends aft of the bow, in the directions extending towards the port bow bulwark 206 and starboard bow bulwark 208 (FIG. 4). In one embodiment, the top panel 202 sealedly engages the bulwarks 204, 206, 208, thereby creating a forward top deck and as shown in FIG. 5 a corresponding compartment 210 under the deck that is, from the top side of the tender, sealed from the elements. In one embodiment, additional aft panels are installed engaging the aft edge 212 of the top panel 202, extending downward to engage the sole of the cockpit area 214, fully sealing the forward compartment when the top panel is retracted. In one embodiment, the aft panels are molded into the body of the tender and the aft edge 212 of the top panel 202 sealedly engages these aft molded panels and also sealedly engages a console housing 216. In one embodiment, the edges of the top panel do not sealedly engage the bulwarks.

In the retracted position (FIGS. 4 and 5), the top panel 202 adds structural integrity to the tender. In one embodiment, the top panel 202 is reinforced with rails that traverse the top panel 202 in the port/starboard orientation. The top panel 202 engages the bulwarks 204, 206, 208 and is securely situated using the force applied by the motorization mechanism. In another embodiment, the top panel 202 engages the bulwarks 204, 206, 208 and is securely situated using mechanical fasteners commonly utilized in the art.

The bimini hard-top mechanism 200 comprises at least one, and preferably two main pillars 216*p* and 216*s*. The pillars 216*p*, 216*s* are constructed from at least one of aluminum, stainless steel, titanium and composite materials. The pillars 216*p*, 216*s* comprise at least one hinged joint that allows the pillars to fold upon themselves to allow the bimini hard top mechanism 200 to retract. In one embodiment, pillar hinge joints actuate using at least one motor assembly. The motor assembly comprises at least one of a direct current motor, stepper motor, gear head transmission, chain drive, rigid chain actuator, belt drive, rigid belt actuator, screw drive, winch, rack and pinion, and any other motorized assemblies known in the art.

At the most distal end of each pillar 216*p*, 216*s* a hinge 218*p*, 218*s* communicates with a top panel 202. When retracted, the angle between the top panel 202 and the pillars 216*p*, 216*s* approaches 0°, but in the upright position, the angle approaches 90°. The angle of the top panel 202, when in the upright position, is adjustable. In one embodiment, the angle of the top panel 202 adjusts automatically based on input from sensors that detect at least one of wind speed, wind direction, tender speed, and tender direction.

The adjustment of the angle of the top panel 202 is actuated by at least one brace. In a preferred embodiment there are two braces, a port side brace 220*p* and a starboard side brace 220*s*, that correspond to a port side pillar 216*p* and starboard side pillar 216*s* respectively. The port side brace 220*p* extends aft from the port side pillar 216*p* to hingedly engage the top panel 202 proximate the port side edge 222*p* of the top panel 202, and the starboard side brace 220*s* extends aft from the starboard side pillar 216*s* to hingedly engage the top panel 202 proximate the starboard side edge 222*s* of the top panel 202. The braces 220*p*, 220*s* each hingedly engage their respective pillars 216*p*, 216*s*.

In one embodiment, the pillar-side hinge assembly 224*p*, 224*s* of a brace 220*p*, 220*s* resides in a channel in the pillar. A hinge assembly 224*p*, 224*s* can move within a channel 225*s*. 225*p* (only 225*s* shown in detail view for efficiency of illustration) which causes the angle of the top panel 202 to change. In particular, as a hinge assembly 224*p*, 224*s* travels distally within a pillar channel, the angle between a pillar 216*s*, 216*p* and a brace 220*s*, 220*p* increases, causing the brace-to-top panel hinge 226*s*, 226*p* (226*p* as a port-side brace-to-top panel hinge is not visible in the figures, as it is occluded by the top panel 202) angle to decrease, which results in the angle of the top panel/pillar apex to increase.

A pillar-side hinge assembly 224*p*, 224*s* slides within a pillar channel manually when a force is applied to either the top panel 202 or a brace 220*s*, 220*p*. When the desired angle of the top panel 202 is reached, a pillar-side hinge assembly 224*p*, 224*s* is mechanically secured in place using fastening mechanisms well known in the art. In one embodiment, a pillar-side hinge assembly 224*p*, 224*s* slides within a pillar channel due to a linear actuator. The linear actuator is one of a chain drive, rigid chain actuator, belt drive, rigid belt actuator, screw drive, winch, rack and pinion, and any other linear actuator known in the art.

In one embodiment of the tender, the composite monohull 102 has a channel that substantially circumscribes the tender, proximate the bulwarks, which accommodates at least one sponson 106. The sponson 106 adds additional buoyancy, stability against capsize, and protects the composite monohull 102 from collision damage.

In one embodiment, the sponson 106 is a polyurethane sheath surrounding closed-cell foam. The foam provides shock absorption, and is impervious to being deflated. The foam can be molded to make a profile that complements the aesthetics of the tender. In another embodiment, the foam core is not solid, but rather a series of high-density foam tubes packed into a series of chambers. The chambers are inflatable, but the foam preserves a majority of buoyant properties of the intact chambers in the event of deflation or a puncture.

In one embodiment, the sponson 106 is an air/foam hybrid comprising an internal inflatable air bladder surrounded by a foam-filled outer sheath. The outer sheath remains aesthetically wrinkle-free due to the tension provided by the underlying air bladder, provides superior shock absorption, and the foam prevents total sponson deflation. The foam can be molded to make a profile that complements the aesthetics of the tender.

The sponsons 106 may be air-holding tubes that are substantially cylindrical in shape comprising monohull 102 attachment points. The sponsons 106 may instead be D-shaped so that the monohull 102 maintains a lower profile. The sponsons 106 may also be extrusions of a substantially compliant material, such as rubber, PVC, plastic, or any sponson material known in the art.

In another embodiment, absent a sponson channel, at least one sponson 106 is attached to the monohull 102. In this embodiment the sponsons 106 are mechanically fastened to the monohull 102 using fasteners well known in the art.

The tender 100 is powered by at least one of a fuel engine, electric motor, and fuel hybrid-electric motor. A fuel engine is configured to be one of an outboard configuration and inboard configuration. The fuel engine is one of a propeller drive well known in the art and an impeller-driven pump jet drive well known in the art. An electric motor is configured to be one of an outboard configuration and inboard configuration. The electric motor is one of a propeller drive well known in the art and an impeller-driven pump jet drive well known in the art. A fuel hybrid-electric motor is configured to be one of an outboard configuration and inboard configuration. The fuel hybrid-electric motor is one of a propeller drive well known in the art and an impeller-driven pump jet drive well known in the art.

Figure 7:
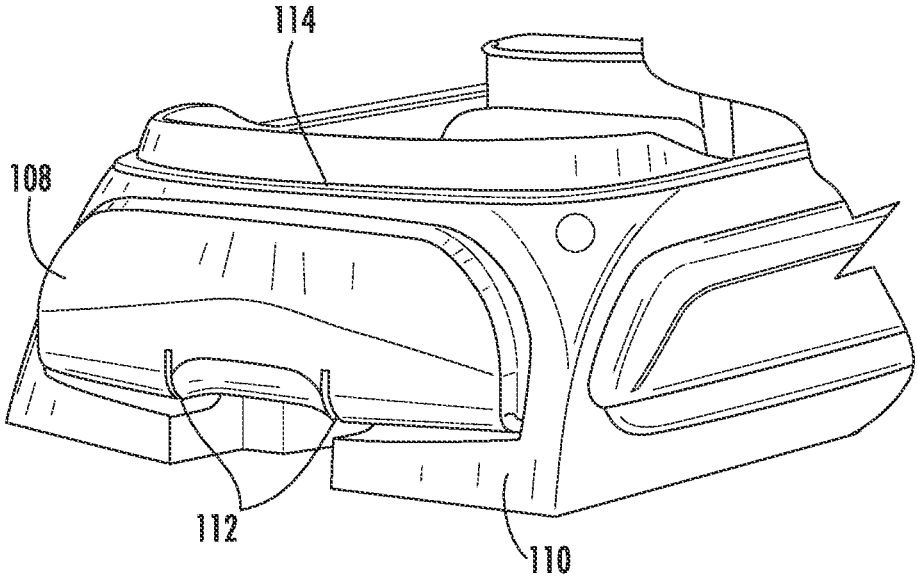
FIG. 7 is a rear view of one embodiment of the retractable rear deck of the tender.

FIG. 1 illustrate one embodiment of the tender 100 wherein a stern deck 108 extends aft from the transom 110 capable of bearing the weight of multiple persons. The preferred embodiment is a tender 100 with inboard propulsion so that the stern deck 108 extends substantially across the transom 110. In one embodiment, the stern deck 108 hingedly attaches to the aft side of the transom using mechanical fasteners and hinge assemblies well known in the art. The hinge assemblies 112 allow the stern deck to hingedly swing roughly 90° of travel so that when extended it is substantially parallel with the waterline and when in the upright position it is substantially parallel with the transom 110. FIG. 7 illustrates the tender 100 with the stern deck 108 positioned upwards to fold inwards towards the transom bulwark 114 so that the length of the tender 100 is minimized which is conducive to efficiently storing the tender 100 on a yacht. Similarly, when the tender 100 is being piloted through water, the stern deck 108 is preferably positioned upwards to fold towards the transom bulwark 114.

FIGS. 8-9 are alternate views of the invention.

Many modifications and other embodiments of the invention will come to the mind of one skilled in the art having the benefit of the teachings presented in the foregoing descriptions and the associated drawings and photos. Therefore, it is to be understood that the invention is not to be limited to the specific embodiments disclosed, and that modifications and alternate embodiments are intended to be included within the scope of the claims supported by this specification.

What is claimed is:

1. A lightweight tender comprising:

a hull constructed from substantially a single piece of composite material, the hull comprising a gunwale;

a retractable pillar attached proximate an interior surface of the hull, wherein the retractable pillar defines a longitudinally extending channel;

a bimini cover made from a rigid material pivotingly attached to the retractable pillar, the bimini cover defining a top deck when the retractable pillar is in the retracted orientation, and the bimini cover defining a bimini top when the retractable pillar is in the extended orientation; and a brace having a first end and a second end, wherein the first end is hingedly attached to the bimini cover and the second end travels within the longitudinally extending channel of the retractable pillar such that the angle between the bimini cover and the retractable pillar increases as the brace travels distally within the longitudinally extending channel.

2. The lightweight tender of claim 1 wherein the bimini cover seals against the gunwale when in a closed position, defining a compartment that is substantially sealed.

3. The lightweight tender of claim 1 wherein the composite material is carbon fiber.

4. The lightweight tender of claim 1 wherein the bimini cover is made from composite material.

5. The lightweight tender of claim 4 wherein the composite material is carbon fiber.

6. The lightweight tender of claim 1 further comprising a folding dive platform attached to a transom formed with the hull, wherein the folding dive platform folds upwards into a closed position that is substantially parallel to the transom and also folds outwards into an open position that is substantially perpendicular to the transom.

7. The lightweight tender of claim 1 further comprising a sponson attached to the hull, the sponson substantially circumscribing the tender.

8. The lightweight tender of claim 7 wherein the sponson comprises closed cell foam surrounded by a polyurethane sheath.

9. The lightweight tender of claim 1 further comprising an inboard motor.

10. A lightweight tender comprising:

a hull constructed from substantially a single piece of carbon fiber material, the hull defining a transom and comprising a gunwale and a sponson that substantially circumscribes the hull, the hull comprising a carbon fiber folding dive platform attached to a transom, wherein the dive platform folds upwards into a closed position that is substantially parallel to the transom and also folds outwards into an open position that is substantially perpendicular to the transom;

a retractable pillar attached proximate an interior surface of the hull, wherein the retractable pillar defines a longitudinally extending channel;

a carbon fiber bimini cover pivotingly attached to the retractable pillar, the bimini cover defining a top deck when the retractable pillar is in the retracted orientation, and the bimini cover defining a bimini top when the retractable pillar is in the extended orientation, the bimini cover also defining a substantially sealed compartment when the retractable pillar is in the retracted orientation;

a brace having a first end and a second end, wherein the first end is hingedly attached to the bimini cover and the second end travels within the longitudinally extending channel of the retractable pillar such that the angle between the bimini cover and the retractable pillar increases as the brace travels distally within the longitudinally extending channel.

11. The lightweight tender of claim 10 further comprising an inboard internal combustion motor.

* * * * *